US011319938B2

(12) United States Patent
Iwanaji et al.

(10) Patent No.: US 11,319,938 B2
(45) Date of Patent: May 3, 2022

(54) SWASH-PLATE TYPE PISTON PUMP

(71) Applicant: KYB Corporation, Tokyo (JP)

(72) Inventors: Tetsuya Iwanaji, Kanagawa (JP); Masaya Abe, Kanagawa (JP); Takeshi Kodama, Kanagawa (JP)

(73) Assignee: KYB CORPORATION, Tokyo (JP)

( * ) Notice: Subject to any disclaimer, the term of this patent is extended or adjusted under 35 U.S.C. 154(b) by 606 days.

(21) Appl. No.: 16/316,131

(22) PCT Filed: Mar. 31, 2017

(86) PCT No.: PCT/JP2017/013559
§ 371 (c)(1),
(2) Date: Jan. 8, 2019

(87) PCT Pub. No.: WO2018/008209
PCT Pub. Date: Jan. 11, 2018

(65) Prior Publication Data

US 2021/0285430 A1 Sep. 16, 2021

(30) Foreign Application Priority Data

Jul. 8, 2016 (JP) ..... JP2016-135945

(51) Int. Cl.
*F04B 1/2078* (2020.01)
*F04B 1/324* (2020.01)
(Continued)

(52) U.S. Cl.
CPC ..... *F04B 1/2078* (2013.01); *F04B 1/324* (2013.01); *F04B 53/14* (2013.01); *F04B 53/16* (2013.01);
(Continued)

(58) Field of Classification Search
CPC ..... F04B 1/2078; F04B 1/324; F04B 53/14; F04B 53/16; F04B 1/20; F04B 49/123;
(Continued)

(56) References Cited

U.S. PATENT DOCUMENTS 2,915,985 A * 12/1959 Budzich ..... F04B 49/08 92/57
3,190,232 A 6/1965 Tadeusz
(Continued)

FOREIGN PATENT DOCUMENTS

DE 1703965 B2 8/1973
DE 2630106 A1 1/1977
(Continued)

*Primary Examiner* — Kenneth J Hansen
*Assistant Examiner* — David N Brandt
(74) *Attorney, Agent, or Firm* — Rabin & Berdo, P.C.

(57) ABSTRACT

A swash-plate type piston pump includes a cylinder block configured to be rotated with rotation of a driving shaft, a plurality of pistons accommodated in a plurality of cylinders provided in the cylinder block, a swash plate configured to reciprocate the piston so that a volume chamber of the cylinder is expanded/contracted with the rotation of the cylinder block, an biasing mechanism configured to bias the swash plate in a direction where a tilting angle is made larger, a control pin configured to drive the swash plate in a direction where the tilting angle is made smaller in accordance with a rise in a load pressure of a pressure chamber, and a discharge channel configured to discharge the load pressure of the pressure chamber.

7 Claims, 5 Drawing Sheets

(51) Int. Cl.

| | |
|---|---|
| ***F04B 53/14*** | (2006.01) |
| ***F04B 53/16*** | (2006.01) |
| ***F04B 1/03*** | (2020.01) |
| ***F04B 1/146*** | (2020.01) |
| ***F04B 49/12*** | (2006.01) |

(52) U.S. Cl.
CPC ..... *F04B 1/03* (2020.01); *F04B 1/146* (2013.01); *F04B 49/123* (2013.01)

(58) Field of Classification Search
CPC .... F04B 1/30; F04B 1/146; F04B 1/03; F04B 1/12
See application file for complete search history.

(56) References Cited

U.S. PATENT DOCUMENTS

| | | | | |
|---|---|---|---|---|
| 3,431,857 | A | 3/1969 | Jennings et al. | |
| 3,753,627 | A * | 8/1973 | Ward | F04B 49/24 417/213 |
| 3,905,194 | A * | 9/1975 | Reimer | F04B 49/103 60/449 |
| 4,072,442 | A | 2/1978 | Horiuchi | |
| 4,077,745 | A | 3/1978 | Rometsch et al. | |
| 5,207,751 | A | 5/1993 | Suzuki et al. | |
| 2014/0328700 | A1 * | 11/2014 | Iwanaji | F04B 1/295 417/222.1 |
| 2018/0045185 | A1 * | 2/2018 | Draper | F04B 49/002 |

FOREIGN PATENT DOCUMENTS

| | | | |
|---|---|---|---|
| DE | 2441069 | B2 | 2/1978 |
| DE | 2607780 | C2 | 11/1981 |
| DE | 4207566 | C2 | 1/1997 |
| EP | 2784314 | A1 | 10/2014 |
| JP | S4916806 | U | 2/1974 |
| JP | H01267367 | A | 10/1989 |
| JP | H02104987 | A | 4/1990 |
| JP | 2013-113132 | A | 6/2013 |
| WO | 9612889 | A1 | 5/1996 |

* cited by examiner

SWASH-PLATE TYPE PISTON PUMP

TECHNICAL FIELD

The present invention relates to a swash-plate type piston pump.

BACKGROUND ART

A work machine such as an excavator includes a swash-plate type piston pump driven by an engine and adapted to discharge a working oil for driving various hydraulic actuators.

The swash-plate type piston pump disclosed in JP2013-113132A includes a control pin adapted to drive a swash plate in a direction where a tilting angle is made smaller in accordance with a rise in a load pressure supplied to a pressure chamber.

In the aforementioned swash-plate type piston pump, a driving load can be made smaller by decreasing a discharge capacity by tilting the swash plate in the direction where the tilting angle is made smaller. Thus, when a compressor of an air conditioning device is driven by the engine, consumption of power of the engine can be kept substantially constant by making the driving load of the swash-plate type piston pump smaller by tilting the swash plate.

SUMMARY OF INVENTION

In the aforementioned swash-plate type piston pump, even if the air conditioning device is stopped and supply of the load pressure to the pressure chamber is stopped, the pressure in the pressure chamber does not become lower quickly in some cases. In this case, the swash plate is not returned easily to a direction where the tilting angle is made larger due to an influence of a remaining pressure.

As described above, in the swash-plate type piston pump including the control pin adapted to drive the swash plate in the direction where the tilting angle is made smaller in accordance with the rise of the load pressure supplied to the pressure chamber, if the pressure in the pressure chamber does not lower quickly when the supply of the load pressure is stopped, the swash plate is not returned easily in the direction where the tilting angle is made larger due to the influence of the remaining pressure, and controllability cannot be ensured, which is a problem.

The present invention has an object to enable the pressure in the pressure chamber to quickly become lower when the supply of the load pressure to the pressure chamber is stopped.

According to one aspect of the present invention, a swash-plate type piston pump includes a cylinder block configured to be rotated with rotation of a driving shaft, a plurality of pistons accommodated in a plurality of cylinders provided in the cylinder block, a swash plate configured to reciprocate the piston so that a volume chamber of the cylinder is expanded/contracted with the rotation of the cylinder block, an biasing mechanism configured to bias the swash plate in a direction where a tilting angle is made larger, a control pin configured to drive the swash plate in a direction where the tilting angle is made smaller in accordance with a rise in a load pressure of a pressure chamber, and a discharge channel configured to discharge the load pressure of the pressure chamber.

DESCRIPTION OF EMBODIMENTS

First Embodiment

Hereinafter, a first embodiment of the present invention will be described by referring to FIGS. 1 and 2.

Figure 1:
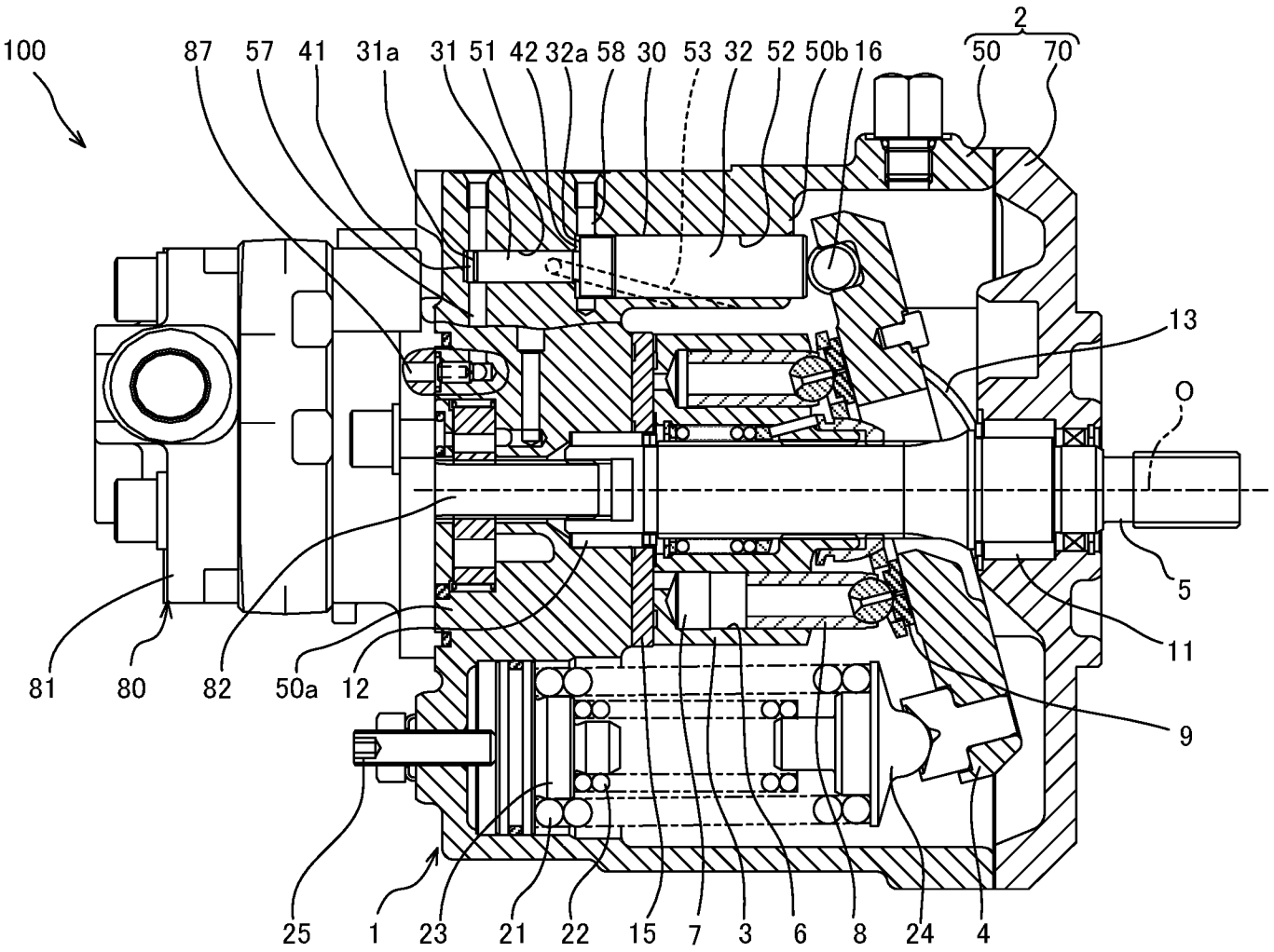
FIG. 1 is a sectional view of a pump unit including a swash-plate type piston pump according to a first embodiment of the present invention.

A pump unit 100 illustrated in FIG. 1 is mounted on a work machine such as an excavator and is driven by an engine (not shown), for example. An air conditioning device (air conditioner) (not shown) is mounted on the work machine, and a compressor of the air conditioning device is also driven by the engine.

The pump unit 100 includes a main swash-plate type piston pump 1 (hereinafter referred to as a pump 1) and a sub gear pump 80 (hereinafter referred to as a pump 80). The pump 1 and the pump 80 are provided side by side on a rotation axis O.

In the aforementioned work machine, elements consuming power of the engine includes the pump 1, the pump 80, and the compressor of the air conditioning device. The pump 1 can change a discharge capacity (displacement volume) in accordance with a change in power consumption of each element. As a result, a total value of power consumption is kept substantially constant.

The pump 80 includes a pair of gears (not shown) meshed with each other and a casing 81 accommodating them.

Rotation is transmitted to one of the gears from the engine through a driving shaft 82 and a driving shaft 5. As a result, a working fluid (working oil) is suctioned from a tank (not shown) through a pipeline (not shown) to a volume chamber moved by the rotation of the gear with a space between the pair of gears meshed with each other as the volume chamber. Moreover, the working fluid discharged from the volume chamber to a discharge port is led to a fluid pressure actuator (not shown) through the pipeline (not shown).

The pump 1 includes a cylinder block 3, a plurality of pistons 8 reciprocated with respect to the cylinder block 3, a swash plate 4 followed by the piston 8, and a casing 2 accommodating them.

Rotation is transmitted to the cylinder block 3 from the engine through the driving shaft 5. When the cylinder block 3 is rotated, the piston 8 is reciprocated with respect to the cylinder block 3.

As a result, the working fluid is suctioned into a volume chamber 7 defined by the piston 8 from the tank through the pipeline (not shown). Moreover, the working fluid discharged from the volume chamber 7 to the discharge port is led to the fluid pressure actuator through the pipeline (not shown).

Hereinafter, the pump 1 will be described in detail.

The casing 2 includes a cylindrical pump housing 50 with a bottom and a lid-shaped pump cover 70 closing an opening portion of the pump housing 50. On an inner side of the pump housing 50, the cylinder block 3, the swash plate 4 and the like are accommodated. The pump cover 70 is fastened to the pump housing 50 by a plurality of bolts.

The cylinder block 3 is rotated with rotation of the driving shaft 5. The driving shaft 5 protrudes from the pump cover 70 to an outside, and the rotation is transmitted from the engine as a power source. The driving shaft 5 is supported by the pump housing 50 via a bearing 12 and is supported by the pump cover 70 via a bearing 11.

In the cylinder block 3, a plurality of cylinders 6 are formed at a certain interval substantially in parallel with the rotation axis O and on substantially the same circumference around the rotation axis O.

The pistons 8 are slidably inserted into the cylinder 6, respectively, and the volume chamber 7 is defined between the cylinder 6 and the piston 8. The piston 8 protrudes from the cylinder block 3 and has one end supported by the swash plate 4 via a shoe 9 in contact with the swash plate 4. The piston 8 is reciprocated while following the swash plate 4 when the cylinder block 3 is rotated and expands/contracts the volume chamber 7.

The pump housing 50 has a bottom portion 50*a* on which a channel (not shown) adapted to supply/discharge the working fluid to/from the volume chamber 7 is formed and a cylindrical side wall portion 50*b* surrounding the cylinder block 3 and the like.

A port plate 15 with which the cylinder block 3 is in sliding contact is provided on the bottom portion 50*a* of the pump housing 50. A suction port (not shown) and a discharge port (not shown) communicating with each volume chamber 7 are formed on the port plate 15. A supply/discharge passage (not shown) communicating with the suction port and the discharge port is formed on the bottom portion 50*a* of the pump housing 50.

In the pump 1, when the cylinder block 3 makes one round, each piston 8 is reciprocated once in the cylinder 6. In a suction stroke in which the volume chamber 7 of the cylinder 6 is expanded, the working fluid from the tank is suctioned into each volume chamber 7 through the suction port via a pipeline (not shown) and a channel (not shown) in the pump housing 50. Moreover, in a discharge stroke in which the volume chamber 7 of the cylinder 6 is contracted, the working fluid discharged from each volume chamber 7 to the discharge port is led to the fluid pressure actuator through the channel (not shown) in the pump housing 50 and the pipeline (not shown).

The swash plate 4 is supported capable of tilting by the pump cover via a bearing 13 in order to make a discharge capacity of the pump 1 variable. The bearing 13 is provided on the pump cover 70.

As is clear from FIG. 1, the tilting springs 21 and 22 interposed between the pump housing 50 and the swash plate 4, serve as a mechanism to bias the swash plate 4 in the direction where the tilting angle is made larger.

The tilting springs 21 and 22 have coil shapes and are interposed between a retainer 23 mounted on the pump housing 50 and a retainer 24 mounted on the swash plate 4. The retainer 23 is provided capable of displacement by the working fluid pressure, and an initial position is adjusted via an adjuster 25.

The tilting springs 21 and 22 have different winding diameters of wire materials, and the tilting spring 22 having a smaller winding diameter is arranged on an inner side of the tilting spring 21 having a larger winding diameter.

As illustrated in FIG. 1, in a state where the tilting angle of the swash plate 4 is the maximum, the tilting spring 21 having the larger winding diameter is interposed between the retainers 23 and 24 in a compressed state. On the other hand, the tilting spring 22 having the smaller winding diameter is in a state where one end is separated from the retainer 24. Then, when the swash plate 4 is tilted exceeding a predetermined angle, the tilting spring 22 is brought into contact with the retainers 23 and 24 and compressed, and a spring force of the tilting springs 21 and 22 given to the swash plate 4 is increased in steps.

Moreover, the pump 1 includes a main control pin (not shown) and a sub control pin 30. The sub control pin 30 includes a first control pin 31 and a second control pin 32.

A discharge pressure of the pump 1 is supplied to the main control pin as a load pressure. A discharge pressure of the pump 80 is supplied to the first control pin 31 as a load pressure. A pilot pressure is supplied to the second control pin 32 as a load pressure when the air conditioning device is operating.

The pump 1 can change the discharge capacity by changing the tilting angle of the swash plate 4 by the main control pin and the sub control pin 30.

The main control pin is provided in parallel with the sub control pin 30 and in the vicinity of the sub control pin 30.

The main control pin is slidably inserted into a main pin cylinder (not shown) formed in the pump housing 50, and one end is brought into contact with the swash plate 4. A main pressure chamber (not shown) is defined between the main pin cylinder and the main control pin.

The discharge pressure of the pump 1 is supplied to the main pressure chamber. The main control pin receives the discharge pressure of the pump 1 on an end surface and presses the swash plate 4 and drives the swash plate 4 against the tilting springs 21 and 22 in the direction where the tilting angle is made smaller.

Figure 2:
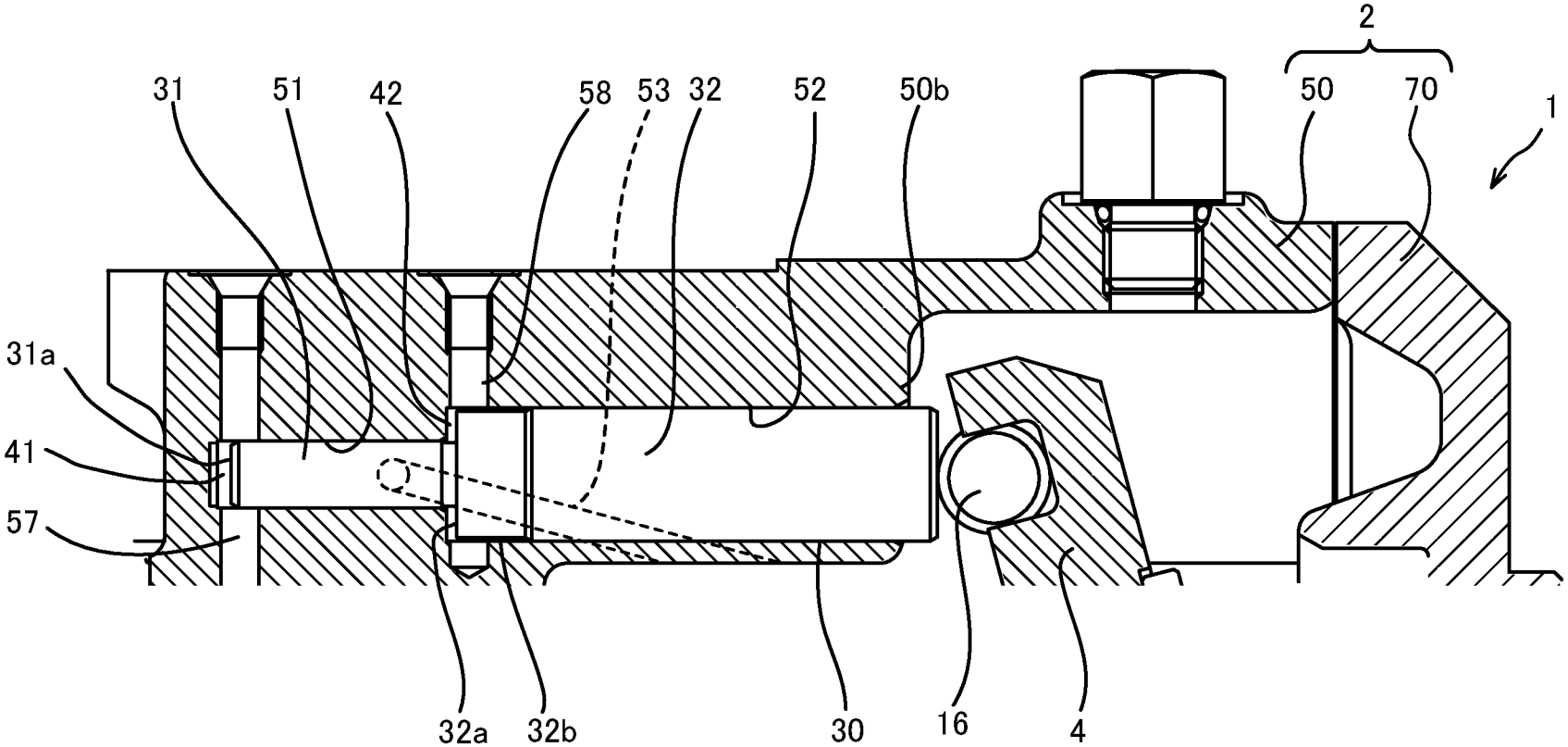
FIG. 2 is a view illustrating an essential part of the swash-plate type piston pump according to a first embodiment of the present invention.

As illustrated in FIGS. 1 and 2, an outer diameter of the first control pin 31 is formed smaller than an outer diameter of the second control pin 32. The first control pin 31 and the second control pin 32 are aligned in series coaxially and are connected to each other.

In this embodiment, the sub control pin 30 is constituted by integrally forming the first control pin 31 and the second control pin 32. On the other hand, the first control pin 31 and the second control pin 32 may be separate bodies and the both may be connected through connecting means so as to constitute the sub control pin 30.

A first pin cylinder 51 into which the first control pin 31 is slidably inserted and a second pin cylinder 52 into which the second control pin 32 is slidably inserted are formed on the side wall portion 50*b* of the pump housing 50 by machining.

In the pump housing 50, a portion faced with the swash plate 4 is open in a state before the pump cover 70 is assembled. Thus, the first pin cylinder 51 and the second pin cylinder 52 can be formed by machining.

A first pressure chamber 41 is defined between the first pin cylinder 51 and the first control pin 31. Therefore, an end surface of the first control pin 31 becomes a pressure receiving surface 31*a* faced with the first pressure chamber 41.

A through hole 57 as a channel adapted to supply the discharge pressure of the pump 80 to the first pressure chamber 41 is formed in the side wall portion 50*b* of the pump housing 50. As a result, the discharge pressure of the pump 80 as a load pressure is supplied to the first pressure chamber 41 through the through holes 87 and 57. The sub control pin 30 is moved to the swash plate 4 side by a rise in the discharge pressure of the pump 80 received on the pressure receiving surface 31*a* of the first control pin 31.

A second pressure chamber 42 is defined between the second pin cylinder 52 and the second control pin 32. Therefore, an end surface (annular stepped portion) of the second control pin 32 becomes a pressure receiving surface 32*a* faced with the second pressure chamber 42.

A through hole 58 as a channel adapted to supply the pilot pressure to the second pressure chamber 42 is formed in the side wall portion 50*b* of the pump housing 50. As a result, the pilot pressure is supplied to the second pressure chamber 42 through the through hole 58. The sub control pin 30 is moved to the swash plate 4 side by a rise in the pilot pressure received on the pressure receiving surface 32*a* of the second control pin 32.

Moreover, a channel 53 having one end opened in an inner peripheral surface of the first pin cylinder 51 and the other end continuing to an inside of the casing 2 is formed in the side wall portion 50*b* of the pump housing 50. The channel 53 will be described later.

A small diameter portion 32*b* is formed on an end portion of the second control pin 32 as illustrated in FIG. 2. As a result, the second control pin 32 is prevented from closing an opening portion of the through hole 58.

The second pressure chamber 42 is connected to a pilot pump (not shown) via the pipeline (not shown) in which the through hole 58 and a switching valve (not shown) are interposed. The switching valve leads the discharge pressure of the pilot pump to the second pressure chamber 42 as a pilot pressure when the air conditioning device is operating.

With the rises of the load pressures supplied to the first pressure chamber 41 and the second pressure chamber 42, respectively, the sub control pin 30 is moved to the swash plate 4 side. Then, a distal end portion of the second control pin 32 protrudes from the second pin cylinder 52 in steps and drives the swash plate 4 in the direction where the tilting angle is made smaller via a follower 16 mounted on the swash plate 4.

The swash plate 4 is held at a tilting angle at which a thrust of the sub control pin 30 and the spring forces of the tilting springs 21 and 22 are balanced. The thrust of the sub control pin 30 is a resultant force of the thrust of the first control pin 31 and the thrust of the second control pin 32. As described above, since the pump 1 includes the first control pin 31 and the second control pin 32, it can control a driving load in accordance with a plurality of the load pressures.

Figure 3A:
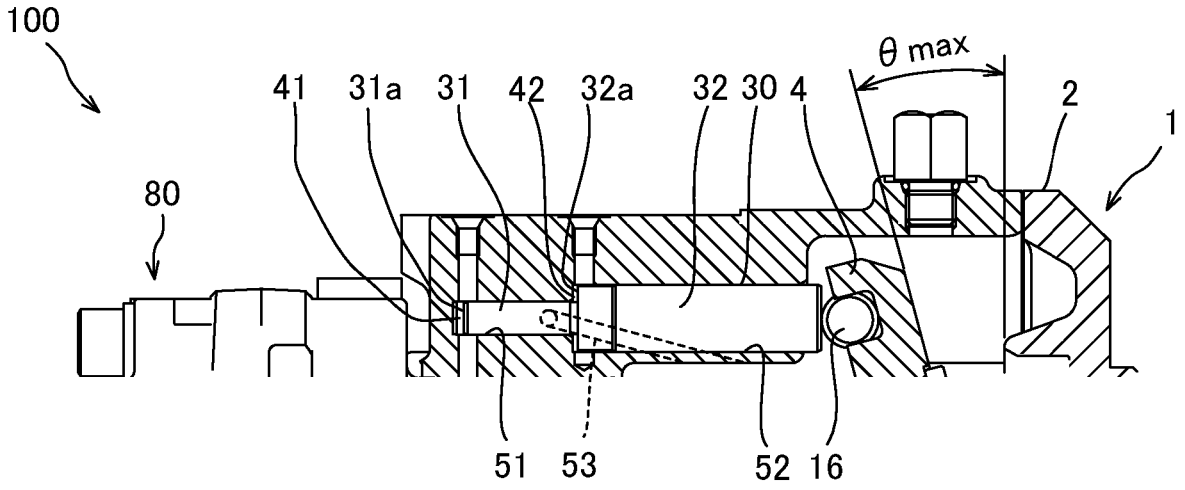
FIG. 3A is a view illustrating a state where a tilting angle of a swash plate is at the maximum.

FIG. 3A illustrates a state where the tilting angle of the swash plate 4 is a maximum value θmax. At this time, the sub control pin 30 is brought into a state having entered into the first pin cylinder 51 and the second pin cylinder 52. In this state, the discharge capacity of the pump 1 becomes the maximum, and the driving load of the pump 1 also is made larger.

With the rises of the load pressures supplied to the first pressure chamber 41 and the second pressure chamber 42, respectively, the sub control pin 30 is moved to a right direction in the figure in steps and drives the swash plate 4 in the direction where the tilting angle is made smaller via the follower 16 mounted on the swash plate 4.

Figure 3B:
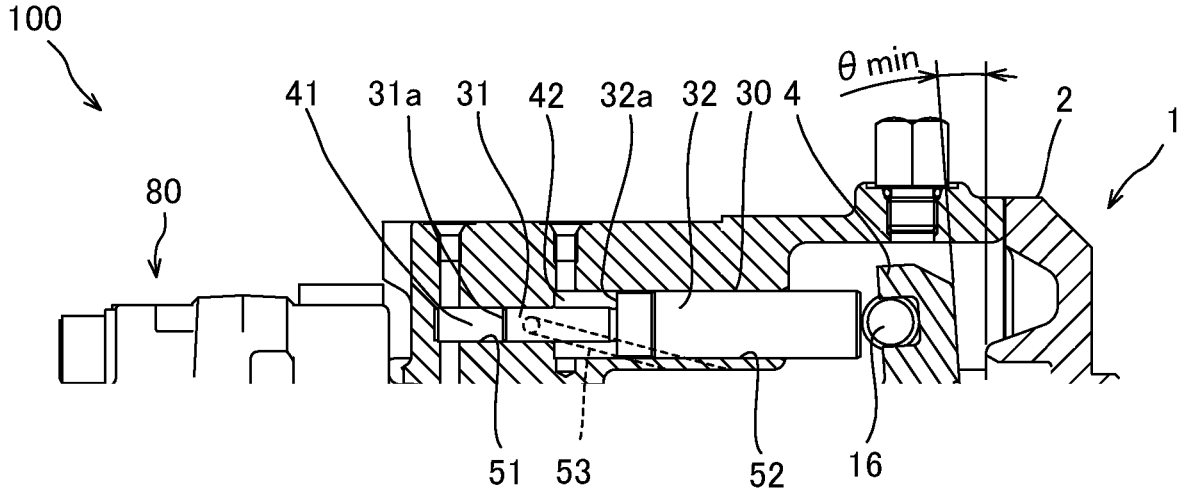
FIG. 3B is a view illustrating a state where a tilting angle of a swash plate is at the minimum.

FIG. 3B illustrates a state where the tilting angle of the swash plate 4 is a minimum value θmin. At this time, the sub control pin 30 is brought into a state protruding from the second pin cylinder 52. In this state, the discharge capacity of the pump 1 becomes the minimum, and the driving load of the pump 1 also becomes smaller.

Subsequently, a working effect of constitution of the pump 1 as above will be described.

As described above, the pump 1 can reduce the driving load by tilting the swash plate 4 by supplying the pilot pressure to the second pressure chamber 42 when the air conditioning device is operating. According to this, even if the air conditioning device is operated, consumption of power of the engine can be kept substantially constant.

However, in the pump 1, even if the air conditioning device is stopped and the supply of the pilot pressure to the second pressure chamber 42 is stopped, the pressure in the second pressure chamber 42 does not become lower quickly in some cases. In this case, the swash plate 4 is not returned easily to the direction where the tilting angle is made larger due to the influence of the remaining pressure and thus, controllability of the pump 1 lowers.

On the other hand, in this embodiment, by providing the channel 53, the pressure in the second pressure chamber 42 can be quickly lowered when the air conditioning device is stopped and the supply of the pilot pressure to the second pressure chamber 42 is stopped.

Hereinafter, description will be made in detail.

The channel 53 is formed in the side wall portion 50*b* of the pump housing 50 as described above, and the one end is opened in the inner peripheral surface of the first pin cylinder 51, while the other end continues to the inside of the casing 2.

That is, in the channel 53, the one end thereof is opened in a sliding gap between the first control pin 31 and the first pin cylinder 51. Moreover, the sliding gap between the first control pin 31 and the first pin cylinder 51 communicates with the adjacent second pressure chamber 42. Thus, the channel 53 and the second pressure chamber 42 communicate through the sliding gap between the first control pin 31 and the first pin cylinder 51.

As a result, the pilot pressure supplied to the second pressure chamber 42 is discharged into the casing 2 through the sliding gap between the first control pin 31 and the first pin cylinder 51 and the channel 53. As described above, the channel 53 functions as a channel for discharging the pilot pressure of the second pressure chamber 42.

When the air conditioning device is stopped and the supply of the pilot pressure to the second pressure chamber 42 is stopped, the pressure in the second pressure chamber 42 is discharged quickly into the casing 2 which is a tank pressure through the sliding gap between the first control pin 31 and the first pin cylinder 51 and the channel 53. Then, the swash plate 4 is quickly tilted in the direction where the tilting angle is made larger by the spring forces of the tilting springs 21 and 22.

The pilot pressure supplied to the second pressure chamber 42 is discharged into the casing 2 at all times through the sliding gap between the first control pin 31 and the first pin cylinder 51 and the channel 53. However, an amount of the working fluid discharged from the second pressure chamber 42 is small with respect to an amount of the working fluid supplied from the pilot pump to the second pressure chamber 42 and thus, when the air conditioning device is operating, the pilot pressure supplied to the second pressure chamber 42 can be raised to a desired pressure without a delay.

Depending on the constitution of the device on the pilot pump side, when the air conditioning device is stopped, the pressure of the second pressure chamber 42 can be discharged through the through hole 58. However, by providing the channel 53 separately from the through hole 58, the pressure of the second pressure chamber 42 can be made stable and lowered quickly regardless of the constitution of an external device connected to the pump 1.

As described above, according to this embodiment, since the pilot pressure of the second pressure chamber 42 is discharged from the channel 53 as the discharge channel, when the supply of the pilot pressure to the second pressure chamber 42 is stopped, the pressure in the second pressure chamber 42 can be lowered quickly.

The closer to the second pressure chamber 42 the position where the channel 53 is opened in the inner peripheral surface of the first pin cylinder 51 is, the quicker the pressure in the second pressure chamber 42 can be lowered when the supply of the pilot pressure to the second pressure chamber 42 is stopped.

Moreover, in this embodiment, one end of the channel 53 is opened in the sliding gap between the first control pin 31 and the first pin cylinder 51, but the one end of the channel 53 may be opened in the sliding gap between the second control pin 32 and the second pin cylinder 52.

When the supply of the pilot pressure to the second pressure chamber 42 is stopped, the sub control pin 30 is moved to the first pressure chamber 41 side by the spring forces of the tilting springs 21 and 22 transmitted through the swash plate 4.

Thus, when the channel 53 is opened in the sliding gap between the first control pin 31 and the first pin cylinder 51, the working fluid adhering to the outer periphery of the sub control pin 30 can flow into the channel 53 easily with the movement of the sub control pin 30. Thus, in this case, the pressure in the second pressure chamber 42 can be lowered more quickly than in the case where the channel 53 is opened in the sliding gap between the second control pin 32 and the second pin cylinder 52.

Figure 4:
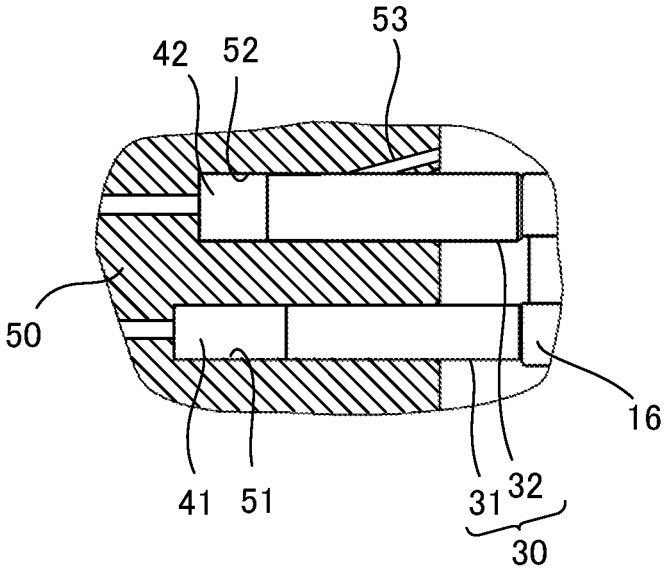
FIG. 4 is a view illustrating a control pin of a swash-plate type piston pump according to a variation.

Moreover, regarding the constitution of the sub control pin 30, it may be such constitution that the first control pin 31 and the second control pin 32 are provided in parallel as illustrated in a variation in FIG. 4.

When the first control pin 31 and the second control pin 32 are connected in series, a space on the circumference for accommodating the first control pin 31 and the second control pin 32 can be made smaller than the case where the first control pin 31 and the second control pin 32 are provided in parallel, and the size of the pump housing 50 can be reduced. Thus, the sizes of the pump 1 and the pump unit 100 can be reduced.

When the first control pin 31 and the second control pin 32 are provided in parallel, the channel 53 discharging the load pressure of the second pressure chamber 42 is provided so that the one end is opened in the sliding gap between the second control pin 32 and the second pin cylinder 52.

Second Embodiment

Figure 5:
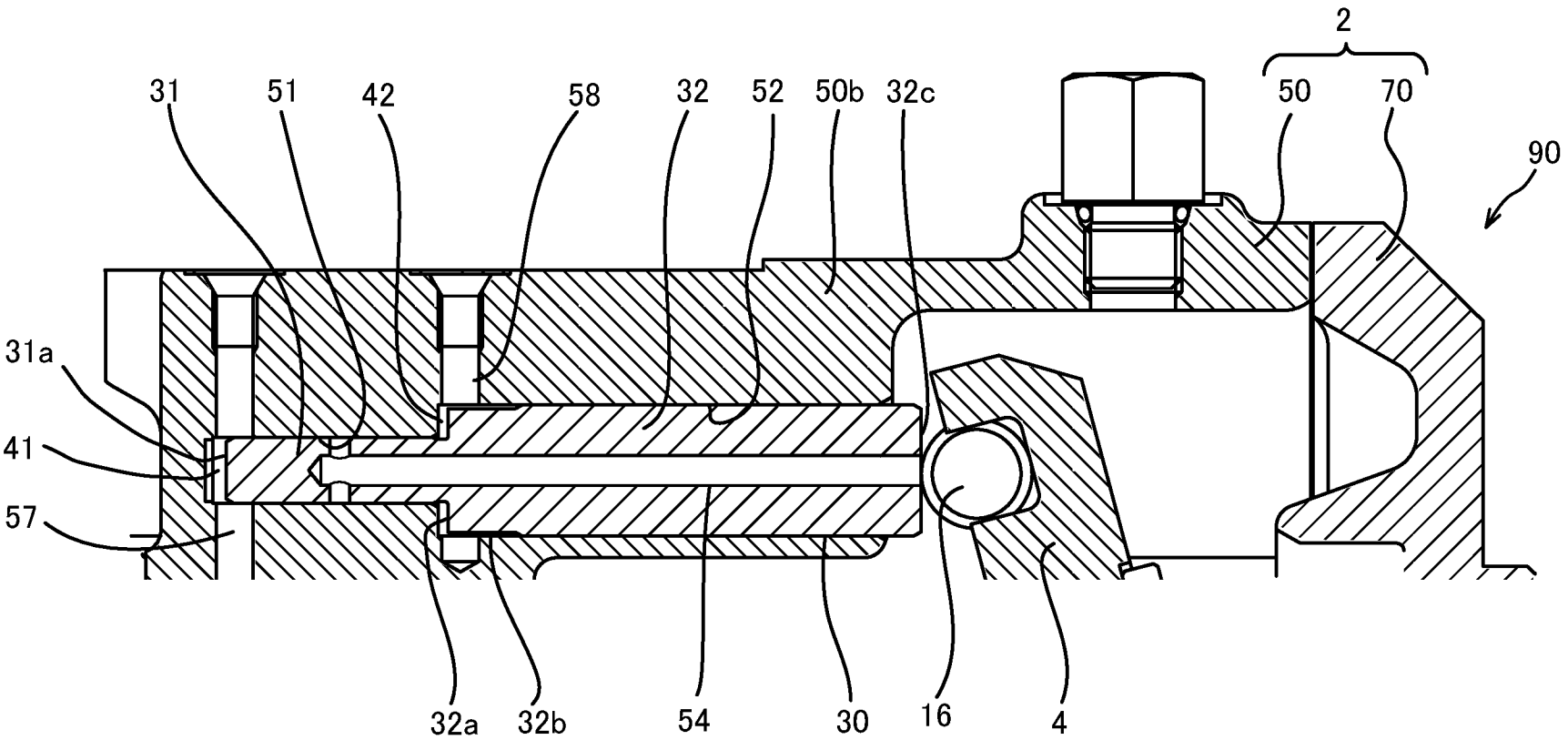
FIG. 5 is a view illustrating an essential part of a swash-plate type piston pump according to a second embodiment of the present invention.

Subsequently, a second embodiment of the present invention will be described by referring to FIG. 5.

A main swash-plate type piston pump 90 (hereinafter referred to as a pump 90) according to the second embodiment is different from the pump 1 according to the first embodiment in the constitution of a channel discharging a pilot pressure of the second pressure chamber 42. Hereinafter, the difference from the pump 1 will be mainly described, and the same reference numerals are given to the same constitutions as those in the pump 1 and the description will be omitted.

In the pump 90, a channel 54 for discharging the pilot pressure of the second pressure chamber 42 is formed in the sub control pin 30. The channel 54 has one end thereof opened in an outer peripheral surface of the first control pin 31, while the other end is opened in an end surface 32*c* of the second control pin 32.

A position where the channel 54 is opened in the outer peripheral surface of the first control pin 31 is set so as to face the inner peripheral surface of the first pin cylinder 51 in a state where the tilting angle of the swash plate 4 is the minimum value θmin so that the channel 54 and the second pressure chamber 42 do not directly communicate with each other.

According to the pump 90 according to this embodiment, a working effect similar to that of the pump 1 according to the first embodiment can be obtained. Moreover, in this embodiment, since there is no need to provide a space for forming a channel for discharging the pilot pressure of the second pressure chamber 42 in the casing 2, the size of the casing 2 can be reduced. Thus, the size of the pump 90 can be reduced.

On the other hand, if the channel 53 for discharging the pilot pressure of the second pressure chamber 42 is provided in the casing 2 as in the pump 1 according to the first embodiment, the channel 53 can be machined at the same time as the casing 2 is machined, which can suppress a cost.

Hereinafter, all the constitutions, actions, and effects of the embodiments of the present invention will be described.

The swash-plate type piston pumps 1 and 90 are characterized by including the cylinder block 3 rotated with the rotation of the driving shaft 5, a plurality of the pistons 8 accommodated in a plurality of the cylinders 6 provided in the cylinder block 3, the swash plate 4 reciprocating the piston 8 so as to expand/contract the volume chamber 7 of the cylinder 6 with the rotation of the cylinder block 3, the biasing mechanism (tilting springs 21, 22) for biasing the swash plate 4 in the direction where the tilting angle is made larger, the sub control pin 30 for driving the swash plate 4 in the direction where the tilting angle is made smaller in accordance with the rise of the load pressure (pilot pressure) of the second pressure chamber 42 and the channels 53, 54 for discharging the load pressure of the second pressure chamber 42.

Moreover, the swash-plate type piston pumps 1 and 90 are characterized by including the casing 2 accommodating the cylinder block 3, the piston 8, the swash plate 4, the biasing mechanism (tilting spring 21, 22), and the sub control pin 30, and the sub control pin 30 is slidably inserted into the pin cylinder (the first pin cylinder 51, the second pin cylinder 52) provided in the casing 2, and the one end of the channel 53, 54 is opened in the sliding gap between the sub control pin 30 and the pin cylinder (the first pin cylinder 51, the second pin cylinder 52).

According to these constitutions, since the load pressure of the second pressure chamber 42 is discharged from the channel 53, when the supply of the load pressure to the second pressure chamber 42 is stopped, the pressure in the second pressure chamber 42 can be lowered quickly.

Moreover, the channel 53 is characterized by being provided in the casing 2.

In this constitution, since the channel 53 is provided in the casing 2, the channel 53 can be machined at the same time as the casing 2 is machined, which can suppress the cost.

Moreover, the channel 54 is characterized by being provided in the sub control pin 30.

In this constitution, since the channel 54 is provided in the sub control pin 30, the size of the swash-plate type piston pump 90 can be reduced.

Moreover, the sub control pin 30 is characterized by including the first control pin 31 for driving the swash plate 4 in the direction where the tilting angle is made smaller in accordance with the rise of the load pressure of the first pressure chamber 41 and the second control pin 32 for driving the swash plate 4 in the direction where the tilting angle is made smaller in accordance with the rise of the load pressure of the second pressure chamber 42, the casing 2 including the pump housing 50 for accommodating the cylinder block 3 and the pump cover 70 for closing the opening portion of the pump housing 50, the bearing 13 for supporting the swash plate 4 capable of tilting being provided on the pump cover 70, the first pin cylinder 51 into which the first control pin 31 is slidably inserted and the second pin cylinder 52 into which the second control pin 32 is slidably inserted being formed in the pump housing 50, the first pressure chamber 41 being defined between the first control pin 31 and the first pin cylinder 51, and the second pressure chamber 42 being defined between the second control pin 32 and the second pin cylinder 52.

Moreover, the first control pin 31 and the second control pin 32 are characterized by being provided in parallel.

According to these constitutions, since the first control pin 31 and the second control pin 32 are provided, the driving load of the swash-plate type piston pump 1, 90 can be controlled in accordance with the plurality of load pressures.

Moreover, the first control pin 31 and the second control pin 32 are characterized by being provided by being connected in series.

In this constitution, since the first control pin 31 and the second control pin 32 are provided by being connected in series, a space on the circumference for accommodating the first control pin 31 and the second control pin 32 can be made smaller, and the size of the swash-plate type piston pump 1, 90 can be reduced.

Embodiments of the present invention were described above, but the above embodiments are merely examples of applications of the present invention, and the technical scope of the present invention is not limited to the specific constitutions of the above embodiments.

For example, in the aforementioned embodiment, the pump 1 and 90 are single (1-flow type) pumps in which the working fluid pressurized in each of the volume chambers 7 is discharged from the one discharge port. On the other hand, it may be a multiple pump in which the working fluid pressurized in each of the volume chambers is discharged from the two or more discharge ports.

Moreover, in the aforementioned embodiment, the sub control pin 30 includes the first control pin 31 and the second control pin 32, but it may include only either one of them. For example, if the sub control pin 30 includes the second control pin 32 and does not include the first control pin 31, the channel 53, 54 only needs to be provided so that the one end is opened in the sliding gap between the second control pin 32 and the second pin cylinder 52.

Moreover, in the aforementioned embodiment, one end of the channel 53, 54 is opened in the sliding gap between the sub control pin 30 and the first pin cylinder 51 or in the sliding gap between the sub control pin 30 and the second pin cylinder 52, but it may be opened directly in the second pressure chamber 42. In this case, by providing a throttle such as an orifice in the middle of the channel 53, 54, the pilot pressure supplied to the second pressure chamber 42 can be raised to the desired pressure without a delay when the air conditioning device is operating.

Moreover, in the aforementioned embodiment, the discharge channel is applied for discharging the pressure in the second pressure chamber 42, but it may be applied for discharging the pressure in the first pressure chamber 41.

Moreover, in the aforementioned embodiment, the sub pump is described as the gear pump 80, but the sub pump may be a swash-plate type piston pump or may be a trochoid pump.

When it is the swash-plate type piston pump, the sub pump includes a cylinder block, a plurality of pistons reciprocated with respect to the cylinder block, a swash plate followed by the piston, and a casing accommodating them.

Rotation is transmitted from the engine to the cylinder block through the driving shaft 82 and the driving shaft 5. When the cylinder block is rotated, the piston is reciprocated with respect to the cylinder block.

As a result, the working fluid is suctioned into the volume chamber defined by the piston from the tank through a pipeline. Moreover, the working fluid discharged from the volume chamber to the discharge port is led to the fluid pressure actuator through the pipeline.

With respect to the above description, the contents of application No. 2016-135945, with a filing date of Jul. 8, 2016 in Japan, are incorporated herein by reference.

The invention claimed is:

1. A swash-plate type piston pump, comprising: a cylinder block configured to be rotated with rotation of a driving shaft; a plurality of pistons accommodated in a plurality of cylinders provided in the cylinder block; a swash plate configured to reciprocate each of the plurality of pistons so that a volume chamber of the cylinder is expanded and/or contracted with the rotation of the cylinder block; a biasing-spring mechanism configured to bias the swash plate in a direction where a tilting angle of the swash plate becomes larger; a control pin configured to receive a load pressure of a pressure chamber, to drive the swash plate so that the tilting angle of the swash plate becomes smaller; a discharge channel configured to discharge the load pressure of the pressure chamber; a casing having an inside that is configured to accommodate the cylinder block, the plurality of pistons, the swash plate, the biasing-spring mechanism, and the control pin; and a pin cylinder provided in the casing, wherein the control pin is slidably inserted into the pin cylinder, and the discharge channel includes an axially extending portion with respect to an axis of the control pin having one end that directly opens to the inside of the casing and an other end that opens at all times in a sliding gap defined between an outer peripheral surface of the control pin and the inner peripheral surface of the pin cylinder so that the load pressure of the pressure chamber is discharged from the discharge channel at all times.

2. The swash-plate type piston pump according to claim 1, wherein the control pin includes: a first control pin and a second control pin; the pressure chamber is comprised of a first pressure chamber and a second pressure chamber; the first pressure chamber defined between the first control pin and the pin cylinder; and the second pressure chamber defined between the second control pin and the pin cylinder, the first control pin configured to receive a load pressure of the first pressure chamber, to drive the swash plate so that the tilting angle of the swash plate becomes smaller, and the second control pin configured to receive a load pressure of the second pressure chamber, to drive the swash plate so that the tilting angle of the swash plate becomes smaller; the casing includes: a pump housing configured to accommodate the cylinder block; and a pump cover configured to close an opening portion of the pump housing, and the pump housing includes the pin cylinder; the pin cylinder comprised of a first pin cylinder into which the first control pin is slidably inserted and a second pin cylinder into which the second control pin is slidably inserted.

3. The swash-plate type piston pump according to claim 2, wherein the first control pin and the second control pin are connected in series.

4. The swash-plate type piston pump according to claim 1, wherein the discharge channel is provided in the control pin.

5. The swash-plate type piston pump according to claim 1, wherein the biasing-spring mechanism includes a plurality of coil springs.

6. The swash-plate type piston pump according to claim 1, wherein the biasing-spring mechanism includes a plurality of coil springs each having a diameter different from one another.

7. The swash-plate type piston pump according to claim 1, wherein the casing includes a pump housing and the biasing-spring mechanism includes a spring interposed between the pump housing and the swash plate.

* * * * *